United States Patent [19]

Scheck et al.

[11] Patent Number: 4,639,010

[45] Date of Patent: Jan. 27, 1987

[54] RELEASABLE CROSS-COUNTRY SKI BINDING

[75] Inventors: Georg Scheck, Leonberg; Martin Bogner, Ostfildern; Manfred Schmidt, Sindelfingen; Ulrich Kowatsch, Leonberg, all of Fed. Rep. of Germany

[73] Assignee: GEZE GmbH, Leonberg, Fed. Rep. of Germany

[21] Appl. No.: 823,962

[22] Filed: Jan. 29, 1986

Related U.S. Application Data

[63] Continuation of Ser. No. 557,220, Dec. 2, 1983, abandoned.

[30] Foreign Application Priority Data

Dec. 9, 1982 [DE] Fed. Rep. of Germany ..... 3245668

[51] Int. Cl.[4] ..... A63C 9/02; A63C 9/16

[52] U.S. Cl. ..... 280/615; 280/618; 280/636

[58] Field of Search ..... 280/615, 618, 620, 633, 280/635, 636, 613, 614

[56] References Cited

U.S. PATENT DOCUMENTS

| | | | |
|---|---|---|---|
| 2,831,696 | 4/1958 | Jones | 280/614 |
| 3,079,163 | 2/1963 | De Beausacq | 280/616 |
| 4,098,522 | 7/1978 | Beyl | 280/618 |
| 4,141,570 | 2/1979 | Sudmeier | 280/607 |
| 4,273,354 | 6/1981 | George | 280/614 |
| 4,322,090 | 3/1982 | Loughney | 280/615 |
| 4,353,576 | 10/1982 | Salomon | 280/615 |

FOREIGN PATENT DOCUMENTS

| | | | |
|---|---|---|---|
| 91530 | 10/1983 | European Pat. Off. | 280/615 |
| 81815 | 5/1971 | Fed. Rep. of Germany | 280/615 |
| 2907364 | 9/1980 | Fed. Rep. of Germany | 280/615 |
| 2497595 | 7/1982 | France | 280/615 |

*Primary Examiner*—David M. Mitchell
*Assistant Examiner*—Everett G. Diederiks, Jr.

[57] ABSTRACT

The cross-country ski binding has a plate which is arranged on the upper surface of the ski and is pivotable about a vertical axis located in the ball region of a boot. The plate is held in the central position by means of a latch device which releases to permit rotation of the plate relative to the ski on the occurrence of impermissibly high turning moments relative to the vertical axis and thus relative to the ball region.

12 Claims, 3 Drawing Figures

RELEASABLE CROSS-COUNTRY SKI BINDING

Figures 1, 2, 3:
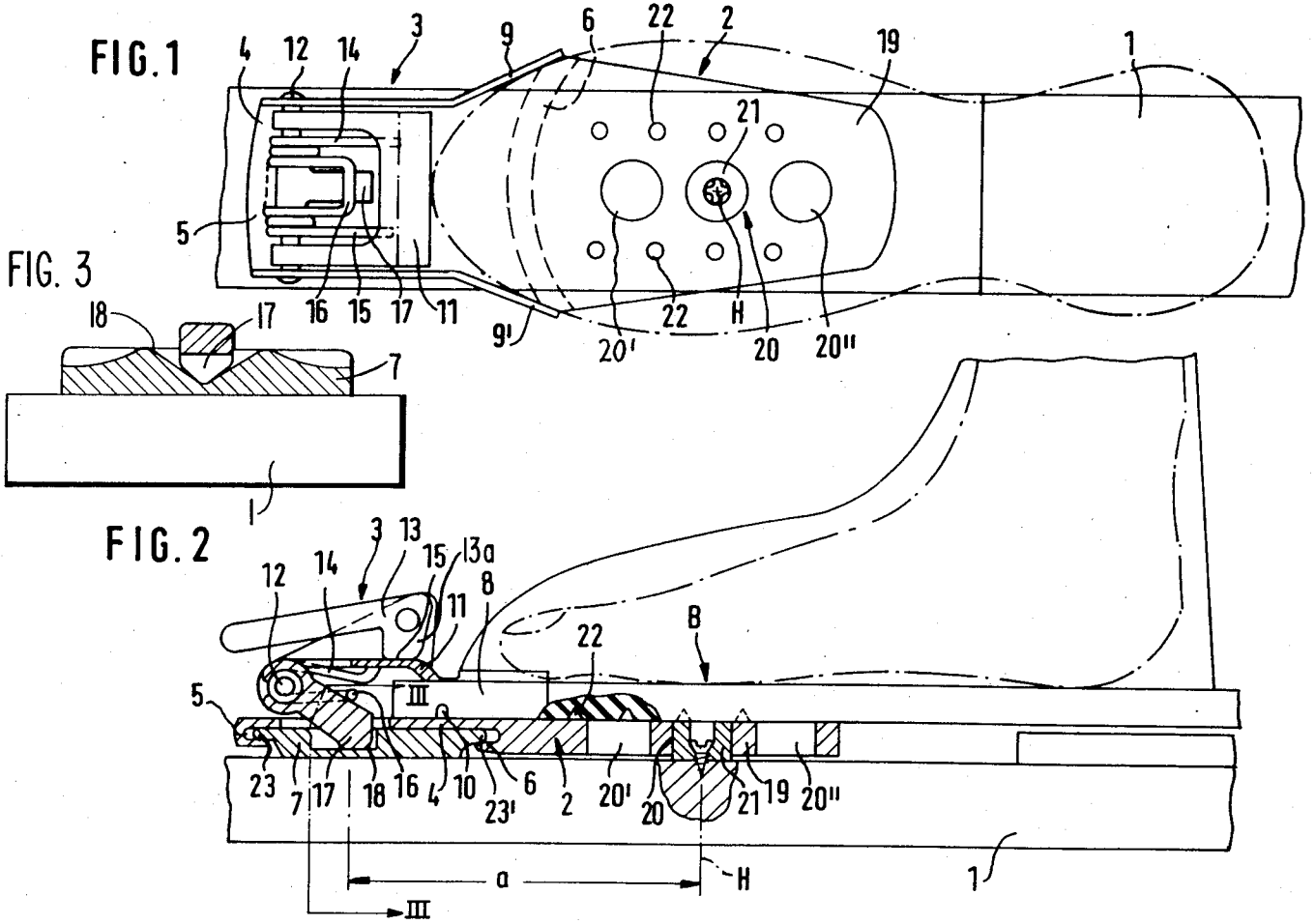

This application is a continuation of application Ser. No. 557,220, filed Dec. 2, 1983, now abandoned. The invention relates to a releasable cross-country ski binding which holds a sole part of a cross-country ski shoe near to the toe region of the ski shoe in the clamped position, either rigidly relative to the ski or elastically, but which leaves the heel region of the cross-country ski shoe freely movable so that it can lift from the upper surface of the ski during skiing, and which releases against the resistance of an adjustable latch device when excessive forces occur between the cross-country ski shoe and the cross-country ski.

Such bindings are, for example, known from East German Pat. No. 81 815 and also from West German Pat. No. 29 07 364. For the release the cross-country ski boot pivots, in the known bindings, about a point of rotation which lies either in the toe region of the cross-country ski shoe or in front of its toe cap. This signifies that release always occurs if excessive moments occur relative to the named point of rotation.

A point of rotation in front of or in the vicinity of the tip of the ski shoe (toe region) however brings the difficulty that even during normal skiing high turning moments occur, for example on an upward incline, which, under certain circumstances, can lead to an unintentional release.

One has attempted to overcome this problem in the known binding described in West German Gebrauchsmuster No. 81 17 530 by displacing the point of rotation into the heel region of the cross-country ski boot or into a position in line with the axis of the shin-bone or tibia. Practical tests in particular have however shown that non-dangerous forces act in the ball region, for example when ascending using the so-called "Grätsch" step (herringbone step) but can lead to undesirable release of the binding because of the torque exerted about the point of rotation in the heel region.

It is accordingly the object underlying the invention to provide a releasable cross-country ski binding which opens reliably when excessive turning moments act on the leg joints and foot joints of the cross-country skier, and which, on the other hand, offers a high degree of reliability against undesirable release.

This object is satisfied in that the cross-country ski shoe is held so that it is capable of pivotal movement about a vertical ski axis in the ball region against the resistance of the latch device.

Thus in accordance with the invention, the center of rotation about which the foot pivots when the binding releases is displaced into the ball region so that forces which would lead to a rotation of the foot relative to this axis lead to a reliable release if they are excessively large. On the other hand, forces which act laterally on the foot in the ball region thereof, as for example when using the herringbone step, do not lead to an undesirable release because these forces do not generate a turning moment relative to the point of rotation in the ball region.

Cross-country skis and also the associated bindings should be constructed to be as light as possible. Accordingly increased significance is attributed to a simple and light construction of the cross-country ski binding.

An advantageous and simple construction is achieved if a plate with a binding arrangement for the sole part is arranged on the upper surface of the ski and is pivotable about the vertical axis in the ball region against the latching resistance. As the retaining members of customary cross-country ski bindings are as a rule connected by means of a base plate it is sufficient with this embodiment of the invention to arrange the base plate in an appropriate pivotable manner and to combine it with a latch device. Thus only a trivial increase in weight need be tolerated when compared with customary, non-releasing bindings.

In one arrangement, which is of particularly simple construction, the plate is releasably secured to a latch carrier and to a journal in the ball region so that, following a safety release, the binding arrangement and the plate can be separated from the ski together with the clamped cross-country ski shoe.

A protection against forces which cause injuries is however also obtained if the plate remains connected to the journal, which is fixedly mounted on the ski, and thus to the ski after a safety release. In this case the plate takes on the function of a ski retaining element.

Preferred embodiments of the plate are described further below, it being important, for an embodiment which is separable from the ski, that a recess is provided for the journal which is fixed to the ski. In order to match the binding to different shoe sizes or in order to change the latching resistance several recesses can be provided in an extension of the plate.

In order to be able to better guide the cross-country ski boot on the ski, lateral guide means in the form of pins, journals, wedges or the like which engage in recesses of complementary shape in the sole of the cross-country ski shoe can be arranged on the extension of the plate.

In a particularly preferred embodiment of the invention the base plate for the binding arrangement has C-shaped front and rear regions which engage around the projecting marginal regions of the latch carrier. These marginal regions preferably each lie on a circular arc with its radius centered on the vertical axis about which the plate rotates together with the binding arrangement.

The required latching resistance is generated by the cooperation of the latching device, which consists of the latching lever, release cam track and spring, with a lever arm disposed between the point of engagement of the latch and the vertical axis. The required latching resistance can be varied not only by a different lever arm but also additionally by the special construction of the release cam track.

In order to facilitate a re-engagement of the cross-country ski binding of the invention in the latched position the release cam track has outwardly directed downwardly sloping engagement ramps.

Through a special construction of the spring i.e., the provision of two spaced coil springs joined by a central hairpin portion the re-engagement is likewise assisted and facilitated when the toe restrainer is open, as in this condition the latching resistance is reduced.

A preferred embodiment of the invention will now be described with reference to the drawings which show:

FIG. 1 a plan view of the cross-country ski binding of the invention;

FIG. 2 a partly sectioned side view of the cross-country ski binding of FIG. 1 with a cross-country ski shoe engaged therein;

FIG. 3 is a section along line III—III of FIG. 2.

The cross-country safety ski binding of FIGS. 1 and 2 includes a plate 2 arranged on the upper surface of the ski 1. The plate 2 carries a binding arrangement 3 which can in principle be of any desired kind. In the illustrated embodiment the binding arrangement consists essentially of a base plate 4 with front and rear, C-shaped, bent around regions 5 and 6 which engage around a plate-like latch carrier 7 fixedly arranged relative to the ski, of toe cheeks 9, 9' which laterally support the sole 8 of the ski shoe, of the pins 10 which secure the sole 8 of the ski shoe in the longitudinal direction of the ski, and finally of a toe restrainer 11 which secures the sole 8 of the ski shoe against lifting.

The toe restrainer 11 is constructed as a plate-like part and is pivotally journalled on a shaft 12 arranged transverse to the ski between the toe cheeks 9. 9'. The toe restrainer 11 can be pressed downwardly from a raised released position into the illustrated clamped position against the force of a spring 14, by means of a clamping lever 13 with a cam projection 13*a*. Lever 13 is likewise pivotally journalled between the toe cheeks 9, 9' above the toe restrainer.

This spring 14 not only has the function of an opening spring for the toe restrainer 11 but also the function of a release spring for the binding arrangement relative to the latch carrier 7. The spring is thus constructed as a single or two-part coil spring the spaced apart ends 15 of which contact the toe restrainer from beneath and the inner ends 16 of which act on a latch lever 17 which is journalled on the shaft 12 and which cooperates with a release cam track 18 on the latch carrier 7.

The release cam track 18 has the shape of a flattened M when viewed in cross-section perpendicular to the longitudinal extent of the ski. The outer legs of the M define upwardly sloping engagement ramps on either side of the latch recess which is of V-shape and is constructed and matched to the latch lever 17 and spring 14 in such a way that, in the illustrated clamped position, a reliable centering of the binding arrangement is obtained, so that an adequate degree of lateral elasticity is achieved during release, and so that re-engagement of the binding arrangement after a release is facilitated by shallow engagement ramps.

An additional advantage is achieved in the released position of the toe restrainer 11, as a result of the combination function of the spring, inasmuch as the load acting on the latching lever 17, and thus the latching force, is diminished, so that the binding arrangement together with the plate 2 can, if required, be separated manually from the latch carrier 7 without a great deal of effort which in the converse also facilitates the re-engagement of the binding with the latch carrier.

The plate 2 has an extension 19 which is either fixedly connected with the base plate 4, in the form of a special component consisting of a resilient synthetic material, or is constructed as an integral component of the same. A recess 20 into which a journal 21 fixed to the ski engages is provided in the extension 19. This journal 21 serves as a center of rotation for the illustrated cross-country safety ski binding and determines the release moment by its lever arm a to the point of engagement of the latch lever 17 in the release cam track 18.

Further recesses 20' and 20" are provided in the extension 19 for adaptation to different shoe sizes and/or to different release values. If, for example, a smaller release value is desired, generally in connection with a smaller shoe, the journal 21 is screwed on in the forward direction in such a way that it engages in the front recess 20', which reduces the lever arm a and leads to the desired reduction in the release value while the spring force remains the same. Naturally more recesses can be provided than are shown.

Cones, wedges or similar lateral guide means 22, which engage in recesses of complementary shape in the sole of the ski shoe, can be arranged on the extension 19 for better lateral centering of the shoe.

It is essential for reliable functioning of the arrangement of the invention that the pivotal mounting of the binding arrangement is about the vertical ski axis H at the journal 21 in the ball region B. The ball region B means the region lying behind the toes in which the ball of the foot transmits substantial forces to the cross-country ski. This is in particular the case during lifting of the heel and when using the herringbone step, in particular when going up hill.

Should undesirably high torsional moments relative to the vertical axis H occur in the illustrated clamped or downhill position the cross-country ski shoe executes a pivotal movement, together with the plate 2 and the binding arrangement arranged thereon, relative to this axis until the plate 2 comes free of the latch carrier 7 which guides it, and is separated from the ski 1 together with the cross-country ski shoe. In this way, as illustrated, complete release from the journal 21 is also possible. It is however also conceivable, within the scope of the invention, that the plate 2 remains connected to the journal 21 after a release, and thus exerts the function of a ski retaining element. In the event of complete separation of the binding arrangement, plate and shoe from the ski a suitable ski retaining element, such as a retaining cable or ski brake, should be provided in order to prevent loss of the ski.

If, on the other hand, lateral disturbing forces should occur in the ball region B at the level of the vertical axis H, these forces do not generate a turning moment relative to this axis, in contrast to the previously described situation, and cannot therefore lead to undesirable release of the binding. A prerequisite for pivotability of the plate 2 about the vertical axis H is also the fact that the marginal regions 23, 23' of the latch carrier 7 are of circular arc-like construction, and preferably with a radius of curvature centered at the vertical axis H. During a pivotal movement the release force is thus determined only by the latching force of the latch lever 17, which is urged into the release cam track 18 by the spring 14, and by the lever arm a, which ensures an exact and readily reproducable release behaviour.

An advantage, with regard to the assembly and matching of the latch carrier 7 and the plate 2, arises as a result of the arrangement of the release cam track 18 above the latch carrier 7, because minor inaccuracies during assembly do not have any substantial effect on the release behaviour.

We claim:

1. A releasable cross-country ski binding for securing to a cross country ski, a shoe having a sole with a toe region, a ball region immediately behind said toe region, and a heel region behind said ball region; said ski binding comprising: means for supporting a toe region of the shoe and a ball region of said shoe, said supporting means comprising a sole plate which includes a forwardly disposed relatively rigid base plate and a rearwardly disposed relatively flexible extension secured to said base plate; means for securing said shoe at said toe region supporting means to an upper surface of a said sole plate while permitting lifting of the heel region of the shoe from the ski during skiing; and means for defining an axis of rotation for the ski shoe relative to the ski, said means for defining said axis of rotation comprising a journal secured to said ski and a corresponding recess arranged in said extension for receiving said journal therein; said axis of rotation extending substantially at right angles to the upper surface of the ski through said ball region supporting means; means for releasing the ski shoe and sole plate from the ski on the occurrence at said toe region of the ski shoe, of lateral forces which correspond to an excessive turning moment about said axis of rotation, including a latch mechanism cooperating with a latch recess, one of said latch mechanism and said latch recess being carried by said sole plate, and the other of said latch mechanism and said latch recess being carried by a latch carrier fixedly mounted on the ski in front of said ball region supporting means.

2. A cross-country ski binding in accordance with claim 1, wherein at least said extension consists of a resilient synthetic material.

3. A cross-country ski binding in accordance with claim 2, wherein said extension has several recesses for selectively receiving said journal, said recesses being spaced from one another in the longitudinal direction of the ski.

4. A cross-country ski binding in accordance with claim 1, comprising means for substantially preventing lifting of said plate relative to the ski at said journal.

5. A cross-country ski binding in accordance with claim 1, comprising lateral guide means arranged on said extension for engaging in recesses of complementary shape in the sole of a ski shoe.

6. A releasable cross-country ski binding for securing to a cross country ski, a shoe having a sole with a toe region, a ball region immediately behind said toe region, and a heel region behind said ball region; said ski binding comprising: means for supporting a toe region of the shoe and a ball region of said shoe, said supporting means comprising a sole plate; means for securing said shoe at said toe region supporting means to an upper surface of a ski while permitting lifting of the heel region of the shoe from the ski during skiing; and means for defining an axis of rotation for the ski shoe relative to the ski, said means for defining said axis of rotation comprising a journal secured to one of said ski and said sole plate, the other one of said ski and said sole plate having a corresponding recess for receiving said journal therein; said axis of rotation extending substantially at right angles to the upper surface of the ski through said ball region supporting means; said securing means having means for releasing the ski shoe from the ski on the occurrence at said toe region of the ski shoe, of lateral forces which correspond to an excessive turning moment about said axis of rotation, including a latch mechanism pivotally mounted on a transverse shaft supported by said sole plate and cooperating with a latch recess, said latch mechanism including a latch member, in operation, resiliently biased into contact with said latch recess, said latch recess being carried by a latch carrier fixedly mounted on the ski in front of said ball region supporting means, said latch carrier including front and rear edges which are of arcuate shape when viewed in plan view and have centers of curvature centered on said axis of rotation, said latch carrier including an upper surface and a release cam track including said latch recess on said upper surface, said front and rear edges of said latch carrier being undercut and spaced from the surface of the ski, said plate including edge means which engage beneath said undercut front and rear edges of said latch carrier for permitting rotation of said plate about said axis relative to said latch carrier, said release cam track having the shape of a flattened M when viewed in a cross-section perpendicular to the longitudinal extent of the ski, the flattened M shape of the release cam track having outer legs defining upwardly sloping engagement ramps on either side of said latch recess, which is of substantially V shape.

7. A cross-country ski binding in accordance with claim 6, comprising coil spring means urging said latch member downwardly into engagement with said latch recess, said coil spring means being disposed around said shaft and having first end means bearing on said latch member and second end means braced against a release lever.

8. A releasable cross-country ski binding for securing to a cross-country ski, a shoe having a sole with a toe region, a ball region immediately behind said toe region, and a heel region behind said ball region; said ski binding comprising: means for supporting a toe region of the shoe and a ball region of said shoe, said supporting means comprising a sole plate; means for securing said shoe at said toe region supporting means to an upper surface of a ski while permitting lifting of the heel region of the shoe from the ski during skiing; and means for defining an axis of rotation for the ski shoe relative to the ski, said means for defining said axis of rotation comprising a journal secured to one of said ski and said sole plate, the other one of said ski and said sole plate having a corresponding recess for receiving said journal therein; said axis of rotation extending substantially at right angles to the upper surface of the ski through said ball region supporting means; said securing means having means for releasing the ski shoe and sole plate from the ski on the occurrence at said toe region of the ski shoe of lateral forces which correspond to an excessive turning moment about said axis of rotation, including a latch mechanism cooperating with a latch recess, one of said latch mechanism and said latch recess being carried by said sole plate, and the other of said latch mechanism and said latch recess being carried by a latch carrier fixedly mounted on the ski in front of said ball region supporting means, said latch carrier having front and rear edges which are of arcuate shape when viewed in plan view, and have centers of curvature centered on said axis of rotation, said front and rear edges of said latch carrier being undercut and spaced from the surface of the ski; said plate having edge means which engage beneath said undercut front and rear edges of said latch carrier for permitting rotation of said plate about said axis relative to said latch carrier, said latch carrier having an upper surface and a release cam track including said latch recess on said upper surface, said release cam track having the shape of a flattened M when viewed in a cross-section perpendicular to the longitudinal extent of the ski, the flattened M shape of the release cam track having outer legs defining upwardly sloping engagement ramps on either side of said latch recess, which is of substantially V shape, said latch mechanism including a latch member supported by said plate and, in operation, resiliently biased into contact with said latch recess, said latch member being pivotally mounted on a transverse shaft supported by said plate, and coil spring means urging said latch member downwardly into engagement with said latch recess, said coil spring means being disposed around said shaft and having first end means bearing on said latch member and second end means braced against a release lever.

9. A cross-country ski binding in accordance with claim 8, wherein a toe restrainer is pivotally mounted about said shaft and bears on said toe region from above; wherein said plate has side cheek means above said toe restrainer; and wherein said release lever is pivotally supported by said side cheek means, and has a cam projection bearing on said toe restrainer.

10. A cross-country ski binding in accordance with claim 9, wherein said second end means bears on an underside of said toe restrainer.

11. A cross-country ski binding in accordance with claim 10, wherein said coil spring means comprises two spaced apart coiled portions joined by a central hairpin shaped portion defining said first end means, and wherein tangs are provided at ends of said coiled portions remote from said hairpin-shaped portion, said tangs defining said second end means.

12. A releasable cross-country ski binding for securing to a cross country ski, a shoe having a sole with a toe region, a ball region immediately behind said toe region, and a heel region behind said ball region; said ski binding comprising: means for supporting a toe region of the shoe and a ball region of said shoe, said supporting means comprising a sole plate which includes a rearwardly disposed extension; means for securing said shoe at said toe region supporting means to an upper surface of said plate while permitting lifting of the heel region of the shoe from the ski during skiing; said means for securing said shoe including a toe restrainer means pivotally mounted on said sole plate, and toggle means urging said toe restrainer means into engagement said said toe region; and means for defining an axis of rotation for the ski shoe relative to the ski, said means for defining said axis of rotation comprising a journal secured to said ski and a corresponding recess defined in said extension for receiving said journal therein; said axis of rotation extending substantially at right angles to the upper surface of the ski through said ball region supporting means; means for releasing the ski shoe from the ski on the occurrence at said toe region of the ski shoe and sole plate of lateral forces which correspond to an excessive turning moment about said axis of rotation, including a latch mechanism cooperating with a latch recess, one of said latch mechanism and said latch recess being carried by said sole plate, and the other of said latch mechanism and said latch recess being carried by a latch carrier fixedly mounted on the ski in front of said ball region supporting means.

* * * * *